US009269505B2

(12) United States Patent
Heins et al.

(10) Patent No.: US 9,269,505 B2
(45) Date of Patent: Feb. 23, 2016

(54) CONTACT MECHANISM OF AN ELECTRIC SWITCHING DEVICE

(75) Inventors: Volker Heins, Rheinbach (DE); Kurt Haendler, Bonn (DE)

(73) Assignee: EATON ELECTRICAL IP GMBH & CO. KG, Shoenefeld (DE)

( * ) Notice: Subject to any disclaimer, the term of this patent is extended or adjusted under 35 U.S.C. 154(b) by 179 days.

(21) Appl. No.: 13/989,830

(22) PCT Filed: Nov. 28, 2011

(86) PCT No.: PCT/EP2011/071215

§ 371 (c)(1),
(2), (4) Date: May 28, 2013

(87) PCT Pub. No.: WO2012/072599

PCT Pub. Date: Jun. 7, 2012

(65) Prior Publication Data

US 2013/0240337 A1 Sep. 19, 2013

(30) Foreign Application Priority Data

Nov. 29, 2010 (EP) ..... 10193007

(51) Int. Cl.

| | |
|---|---|
| ***H01H 1/00*** | (2006.01) |
| ***H01H 9/00*** | (2006.01) |
| ***H01H 1/12*** | (2006.01) |
| ***H01H 1/54*** | (2006.01) |
| ***H01H 77/10*** | (2006.01) |

(52) U.S. Cl.

CPC . *H01H 1/12* (2013.01); *H01H 1/54* (2013.01); *H01H 77/101* (2013.01); *H01H 77/107* (2013.01)

(58) Field of Classification Search

CPC ..... H01H 1/14; H01H 1/22; H01H 1/12; H01H 2001/5894

USPC ..... 200/238

See application file for complete search history.

(56) References Cited

U.S. PATENT DOCUMENTS

| | | | | |
|---|---|---|---|---|
| 3,092,699 | A | 6/1963 | Latour | |
| 4,511,774 | A | 4/1985 | Forsell | |
| 5,313,180 | A | 5/1994 | Vial et al. | |
| 5,596,184 | A | 1/1997 | Mitsuhashi | |
| 5,898,148 | A | 4/1999 | Zacharias et al. | |
| 6,727,788 | B1 * | 4/2004 | Lawson et al. | 335/167 |
| 7,470,870 | B2 * | 12/2008 | Schmidt et al. | 200/400 |

FOREIGN PATENT DOCUMENTS

| | | | |
|---|---|---|---|
| DE | 19700758 | C1 | 8/1998 |
| DE | 102008049789 | A1 | 4/2009 |
| EP | 0560696 | A1 | 9/1993 |

* cited by examiner

*Primary Examiner* — Renee Luebke
*Assistant Examiner* — Lheiren Mae A Caroc
(74) *Attorney, Agent, or Firm* — Leydig, Voit & Mayer, Ltd.

(57) ABSTRACT

A contact mechanism includes a current path having a 360° winding formed by a plurality of conductor sections and having an axis that is perpendicular to a plane in which a rotary contact body is movable. The conductor sections include a first section with a first current conductor that extends to a fixed contact. A second conductor section extends through the fixed and rotary contacts. A third conductor section extends through the rotary contact. A final, conductor section, including a second current conductor, extends to the rotary contact body and runs parallel and in close proximity to the first current conductor. Each of the first and second current conductors are substantially parallel to the rotary contact body in the closed position and are formed as straight and rigid busbars having a length corresponding at least to a length of a contact arm of the rotary contact body.

10 Claims, 2 Drawing Sheets

Fig, 3A

CONTACT MECHANISM OF AN ELECTRIC SWITCHING DEVICE

CROSS REFERENCE TO RELATED APPLICATIONS

This application is a U.S. National Phase application under 35 U.S.C. §371 of International Application No. PCT/EP2011/071215, filed on Nov. 28, 2011, and claims benefit to European Patent Application No. EP 10 193 007.1, filed on Nov. 29, 2010. The International Application was published in German on Jun. 7, 2012, as WO 2012/072599 A1 under PCT Article 21 (2).

FIELD

The invention relates to the contact mechanism of an electric switching device, in particular a low-voltage switching device, whereby the electrodynamic action of currents flowing in parallel is employed in particular for electrodynamic contact separation.

BACKGROUND

For example, EP 0 560 696 A1 discloses a switch in which the stationary contact part is connected to a conductor part that is bent in order to be loop-shaped. The loop-shaped conductor part is bent so that the current flowing through the conductor part subjects the contact arm to an electrodynamic magnetic force, which leads to an opening movement of the contact arm and therefore of the movable contact piece at a predetermined current (short circuit current).

DE 19700758 C1 describes a further development of the above-mentioned contact mechanism where the loop-shaped conductor part comprises at least two firmly interconnected windings, the axes of which form a common winding axis.

Further contact mechanisms are known which are essentially designed so that a switching arc is quickly forced out of contact and/or so that a switching arc is quickly transferred to a quenching chamber. Advantage is taken of the fact that electrodynamic forces result from parallel guidance of the current in a power supply and the current in a contact arm, and these electrodynamic forces push out the contact switching arc located in the opening contact from the contact area (U.S. Pat. Nos. 3,092,699 A or 5,596,184 A).

In another contact arrangement with bent conductor sections, there is, in addition, a displacement of the contact parts when contact is made (DE 102008 049789 A1). In this case, a current loop lying in parallel is either traversed to the electrodynamically reinforced opening or not at all.

Contact mechanisms with a fixed contact part and a bent loop-shaped conductor part have the disadvantage that the supply conductor part (busbar) has a loop-shaped bend thus resulting in a particular space requirement due to the conductor loop. Further, a manufacturing step is required in the manufacture of the bent conductor part.

SUMMARY

In an embodiment, the present invention provides a contact mechanism of an electric switching device comprising a fixed contact, a rotary contact body including at least one contact arm having a length, a moving rotary contact part disposed on at least one end of the contact arm, and supply and discharge busbars. The contact mechanism includes a current path having a 360° winding formed by a plurality of conductor sections and having an axis that is perpendicular to a plane in which the rotary contact body is movable. The plurality of conductor sections comprises a first conductor section including a first current conductor that extends to the fixed contact. A second conductor section extends through the fixed and rotary contacts. A third conductor section extends through the rotary contact. A final conductor section includes a second current conductor extending to the rotary contact body. The second current conductor runs parallel and in close proximity to the first current conductor and each of the first and second current conductors are substantially parallel to the rotary contact body in the closed position. Each of the first and second current conductors are formed as straight and rigid busbars having a length corresponding at least to the length of the at least one contact arm of the rotary contact body.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 3A shows a schematic representation of FIG. 1; and

DETAILED DESCRIPTION

Figure 1:
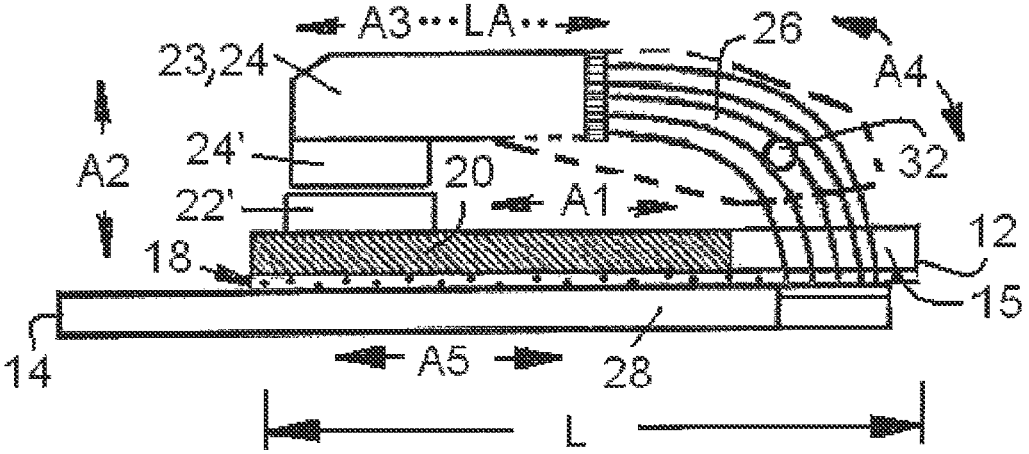
FIG. 1 shows a one-armed contact mechanism.

An aspect of the present invention is to provide a current-carrying arrangement of a contact mechanism that is constructed in a space-saving manner, whereby one takes advantage of the electrodynamic effect of the parallel current flows.

An important aspect of the invention is a contact mechanism of an electric switching device with at least one fixed contact and with a rotary contact body having at least one contact arm on which a moving contact part is arranged at least at one end of the contact, and with supplying and discharging busbars in a plurality of conductor sections, whereby the current path in the contact mechanism forms a winding of about 360° of the conductor sections with an axis that is perpendicular to the plane in which the rotary contact body can move.

In the contact mechanism, there is embodied at least:

- A first rigid busbar which leads to at least one fixed contact,
- A second conductor section extending through the contacts of the contact mechanism,
- A third conductor section extending through the at-least one contact arm of the moving contact part, and
- A final, fifth conductor section formed as the second straight rigid busbar leading to the rotary contact body and extending in close proximity to the first busbar.

A particular advantage of the invention is that the supply and discharge busbars are manufactured and installed as straight busbars made of a high-conductivity material preferably copper. The production step to produce a bent conductor part can be omitted.

The inventive arrangement provides a current path in the contact mechanism, where the current directions—when the contact mechanism is closed—are in parallel in the first conductor section (first busbar), in the fifth conductor section (second busbar), and in the third conductor section (contact arm), but where the current directions in the first conductor section and in the fifth conductor section are in the same sense, while the current direction in the third conductor section is opposite to the aforementioned current directions. When the contact mechanism is open, the rotary contact arm moves away from the first busbar.

The parallel position of the first conductor section (first busbar) and the fifth conductor section (second busbar), and the current flowing in the same sense therein, causes an increased electrodynamic opening movement of the contact compared to conventional arrangements. The result is an accelerated magnetic field with a doubled electrodynamic effect acting on the (at least one) rotary contact arm of the rotary contact body through which the current flows in the opposite direction.

The invention is presented in several embodiments, whereby the features of the respective embodiments may be claimed individually or together, insofar as applicable.

In one embodiment, the power line from the first busbar to the contact arm may pass via an articulation which is formed at the end of the first busbar and on which the contact arm is pivoted. In a second embodiment, a flexible connecting conductor may be inserted between the first busbar and the contact arm. A detailed presentation of this is given below.

Further preferred embodiments of a contact mechanism are proposed in the form of single-pole double contacts. In a first embodiment, a contact part serves as a moving contact part on a contact arm lying opposite a rotary contact body and on each of the contact arm ends, whereby they interact in each case with a fixed contact part. The rotary contact body of this embodiment is preferably designed to have rotational symmetry about the axis of rotation. Thus contact mechanisms are proposed with one-arm or two-arm rotary contact bodies designed according to the invention.

In the case of the contact mechanism with a two-arm rotary contact body, the rotary contact body—as is known from the prior art for such contact mechanisms—can be rotatably mounted in a rotor housing acting against a spring force.

The first busbar section and the fifth busbar section are each designed as a straight busbar. Each busbar has a connecting terminal. The first busbar leads to at least a fixed contact, while the second busbar leads the current to the rotary contact body.

The first busbar (first busbar section) and the second busbar (last busbar section) extend at least the length of the at-least one contact arm of the rotary contact body, and are parallel to one another and preferably in close proximity.

The first busbar and the second busbar can be designed to be insulated from one another, preferably in such a way that they lie on top of one another with an insulating layer between them. Furthermore, other busbar sections that lie closely together should also be designed to be insulated from one another. Thus, the connection conductor (fourth busbar section) passes close to the first busbar, so that insulation should be provided here also, for example by the use of an insulated copper wire as the connecting conductor and/or insulation of the first busbar.

A conductor designed to be jointly moved (connection conductor; fourth busbar section) should be able to follow the movements of the rotary contact body. The connection conductor, which connects the third busbar section with the fifth busbar section may be a copper wire. However, the connection conductor may be in the form of rigid (for example, three) individual parts. The individual parts are connected together and to connection points with the third conductor (contact arm) and the second busbar (fifth busbar section) via an articulation. So-called current articulations, which are constructed to conduct current, are provided at the articulated connection points. The current articulations have spring-loaded axle connections around which they can perform rotations.

Because of the close proximity of the insertable connection conductor to the first busbar in certain embodiments of the invention, the geometric design of the intersection area should be such that contact of the conductor sections is avoided in this area, or that any possible contact occurs preferably with low friction. The first busbar may therefore be designed to be narrower in the intersection area than in the rest of its length. Alternatively, the first busbar may be designed with a passage or a hole in the intersection area through which the wire is passed.

The pivot point or the position of the axis of the rotary contact body should be located at a place where the slightest interaction of the connection conductor (wire) is applied to the rotary contact body, whereby the reciprocal effect of the elastic action of the connecting conductor (compression or expansion) acts on the rotary contact body. Such a place could be, for example, at half the length of the connection conductor.

FIG. 1 shows a single-arm contact mechanism with supply and discharge busbars (20, 28), which are supplied at each end by means of the terminals 12, 14. The individual conductor sections of the current guidance arrangement forming a winding of about 360°. The first conductor section A1 is a rigid supply busbar 20 leading to a fixed contact 22'. The second conductor section A2 passes through the contacts 22', 24' (contact) of the contact mechanism. The third conductor section A3 extends through the rotary contact body (with contact arm 24). The rotary contact body has a centre of rotation (axis) 32. The fourth conductor section A4 according to the design in FIG. 1, is a conductor (connection conductor 26) moving with it, which can preferably be designed as a flexible printed circuit (preferably copper wire).

Figure 3B:
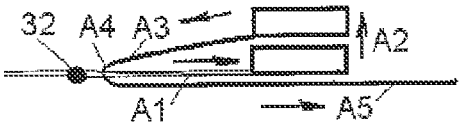
FIGS. 3B and 3C schematically show two embodiments of a single-pole double-contact.
Figure 3B:
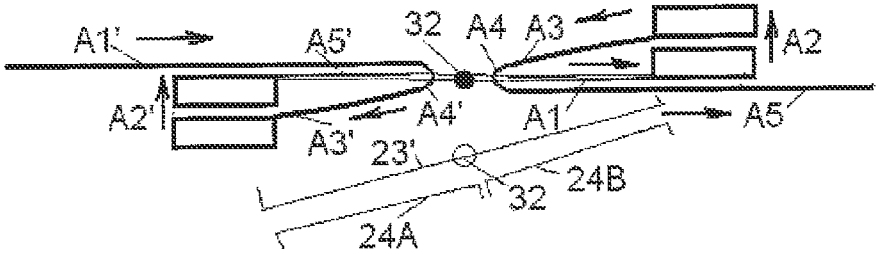
Figure 3C:
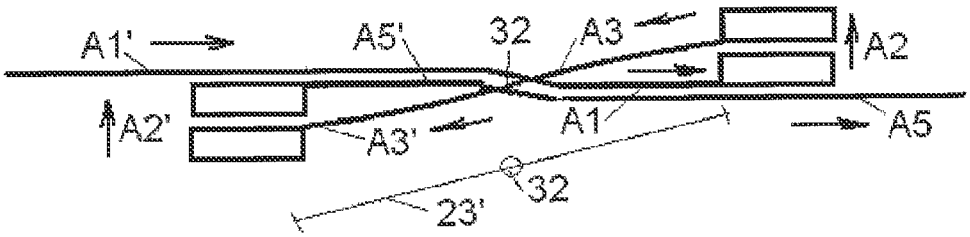

The current path through the said conductor sections forms a winding of about 360°. The last (and fifth) conductor section A5 is the second busbar leading to the rotary contact body 28. According to the invention, the second busbar 28 (conductor section A5) extends in close proximity to the first busbar 20 (first conductor section A1). The winding has an axis perpendicular to the plane in which the moving contact body (contact arm 24) moves. The individual conductor sections in the figure each comprise, with the exception of the connecting conductor 26 (flexible printed circuit), relatively rigid and straight busbars 20, 24, 28 made of highly electrically-conductive material. The connecting conductor (wire 26) is welded in each case to the rotary contact arm 24 and to the second busbar 28, or to one of the rotary contact arms (24A, 24B as shown in FIG. 3B and FIG. 3C).

The contact mechanism according to the invention has a current path where the current directions—viewed with the contact mechanism closed—are in parallel to the first A1, the fifth A5 and the third A3 conductor sections; however, the current directions in the first A1 and the fifth A5 conductor sections are in the same sense, while the current direction in the third conductor section A3 (in this case, at least one contact arm 24) is in the opposite sense to the aforementioned current directions of A1, A5. In this case, the first conductor section 20, A1 and the last conductor section 28, A5 are in close proximity and parallel to one another at least over the length LA of the (at-least one) contact arm 24 (24A, 24B). When the contact mechanism is open, there occurs a separation of the current path between the contact arm 24 and the first busbar 20.

The first busbar 20 and second busbar 28 may be formed to lie on top of one another with an insulating layer 18 between them. The insulating layer may consist of insulating material in the form of paper, cardboard, mica or the like. An alternative embodiment may have the busbars 20, 28 enclosed in plastic and/or be injection molded.

The pivot point 32 of the rotary contact body 24 (23') is located at approximately half the length of the connecting conductor (wire 26) (FIG. 1). The location of the pivot point is selected so that the connection conductor is compressed or expanded as little as possible during the movement of the rotary contact body 24, 23'.

Figure 2:
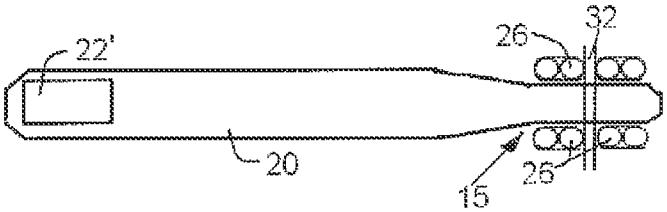
FIG. 2 shows the first conductor section with the fixed contact part in view.

The connection conductor 26 is guided past the first conductor section 20, A 1. A second figure is presented to show this. In FIG. 2, one can see that the conductor section 20, A1 in the region 15 of the connecting conductor 26 is narrow. An opening (15) may also be provided in the first busbar 20 through which the connection conductor is passed, but such a construction is relatively complex and only recommended as a special design.

The diagram in FIG. 3A corresponds schematically to FIG. 1. FIGS. 3B and 3C show schematically further embodiments of a contact mechanism in the form of a single-pole double-contact. In FIG. 3A, one can also see half of the representation of FIG. 3B. FIG. 3B shows a double contact with two flexible connecting leads. FIG. 3C shows a double-contact without a connection conductor. The first and second busbars of these embodiments each receive a power supply by means of terminals that are not shown.

The preferred embodiment according to FIG. 3B illustrates a contact mechanism where the winding of the current path via the first contact arm 24A is arranged in series with the winding of the current path via the second contact arm 24B.

In FIG. 3B, a rotary contact body 23' is shown that is rotatably mounted around the pivot point 32 located at its center. The contact arms shown in FIGS. 24A and 24B (conductor sections A3, A3') lie opposite and extend on both sides of the pivot point 32. The central area at the pivot point of the rotary contact arm is made non-conductive. A contact part is formed as a moving contact part (24' in FIG. 1) at each of the contact arm ends, each of which interacts with a fixed contact part (22' in FIG. 1). On each side of the rotary contact are shown five conductor sections in the form of a current-carrying arrangement. On the left side of FIG. 3B, the conductor sections in the direction of the current (indicated by the arrows), have the reference numerals A1' (first busbar), A4' (connection conductor), A3' (contact arm 24A), A2' (moving contact-fixed contact) and A5' (second busbar). The current flow continues on the right side of the rotary contact. Here, the conductor sections in the direction of the current have the reference numerals A1 (first busbar), A2 (fixed contact-moving contact), A3 (contact arm 24B), A4 (connection conductor) and A5 (second busbar). The current flow on the left side of the rotary contact and the current flow on the right side of the rotary contact each have a winding of about 360°. The embodiment according to FIG. 3B thus corresponds to the double embodiment according to FIG. 1. According to the invention, the busbars A1', A5' are in parallel to the rotary contact arm 24A while the busbars A1, A5 are parallel to the rotary contact arm 24B in the closed position of the rotary contact.

The two connection conductors (jointly movable conductor) (conductor sections A4 and A4') are welded on the one hand to the moving contact arms (24A, 24B) and on the other hand, to the assigned current conductor (current conductor sections A5, A5').

FIG. 3C shows a single-pole double-contact without a connecting wire, whereby the rotating contact body 23' is rotatably mounted (as shown in FIG. 3B) at the pivot point 32 located at its center. The third conductor section A3' of the current path extends through the first contact arm 24A while the third conductor section A3 of the current path extends through the second contact arm 24B. The current (current path with reference numerals A3 and A3') passes across the entire length of the two-arm rotary contact body 23'.

The contact mechanism of this embodiment does not require a connection conductor. The current does not pass through an articulation at the rotary contact body nor via a flexible connection conductor. Due to the omission of a connection conductor, no mechanical interaction of a connecting conductor (wire) is provided with the rotary contact body, which should be noted as a particular advantage of this embodiment.

The current path in the contact mechanism according to FIG. 3C may be considered to be in the form of a loop 8.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

REFERENCE NUMERALS

12 14 Connection terminals at the supply and discharge busbars 20, 28

15 Intersection area, recess

18 Insulating layer

A1' . . . A5 Conductor sections

A1' . . . A5' Conductor sections

20 Busbar with at least one fixed contact

L Length of busbars

LA Length of contact arm 24A, 24B

22' Contact part (fixed contact)

23 (24) Rotary contact body

23' Two-arm rotary contact body

24A 24B Contact arm (lever arm)

24' Contact part (moving contact part)

26 Connection conductor; flexible (articulated) conductor; wires

28 Busbar leading to rotary contact body

32 Pivot point, axis of rotation

The invention claimed is:

1. A contact mechanism of an electric switching device comprising a fixed contact, a rotary contact body including a contact arm having a length, a moving rotary contact part disposed on at least one end of the contact arm, and supply and discharge busbars, the contact mechanism including a current path having a 360° winding formed by a plurality of conductor sections and having an axis that is perpendicular to a plane in which the rotary contact body is movable, the plurality of conductor sections comprising:

a first conductor section including a first current conductor formed as a first straight and rigid busbar that provides a first busbar current path that extends to the fixed contact;

a second conductor section that extends through the fixed and rotary contacts;

a third conductor section that extends through the rotary contact body; and a final conductor section including a second current conductor formed as a second straight and rigid busbar that provides a second busbar current path and that extends to the rotary contact body, the second busbar current path running parallel and in close proximity to the first busbar current path and each of the first busbar current path and the second busbar current path being substantially parallel to a current path provided by the rotary contact body in the closed position, wherein each of the first and second busbar current paths have a length at least as long as the length of the contact arm of the rotary contact body.

2. The contact mechanism recited in claim 1, further comprising a fourth conductor section in the form of a connecting conductor extending between the rotary contact body and the second current conductor, the fourth conductor section following movements of the rotary contact body.

3. The contact mechanism recited in claim 2, wherein the connecting conductor is a copper wire.

4. The contact mechanism recited in claim 2, wherein the connecting conductor is formed by rigid individual pieces which are connected together and to connection points with the rotary contact body and the second current conductor in an articulated manner.

5. The contact mechanism recited in claim 2, wherein the first current conductor is narrower in an intersection region with the connecting conductor than over a remaining length.

6. The contact mechanism recited in claim 2, wherein the rotary contact body includes a pivot point positioned in a location where a lowest interaction of the connecting conductor is applied to the rotary contact body.

7. The contact mechanism recited in claim 2, wherein the contact system is constructed as a single-pole double-contact, whereby the moving contact body is formed as a two-armed rotary contact body having first and second contact arms lying opposite one another, while a contact consisting of the rotary contact body and the fixed contact is formed at the lever arm ends, whereby the current path through each contact arm of the rotary contact body in the order of current flow is as follows:

via a first busbar, via a first connection conductor lying between a first busbar and a first contact arm of the rotary contact body, via the first contact arm, via the contact to a first contact arm with a contact part of the rotary contact body and the fixed contact body, from there it passes to a second busbar assigned to the first contact arm, whereby the current flow from the second busbar to the first busbar assigned to the second contact arm via the contact elements of rotary contact body and fixed contact of the second contact arm via the contact at the second contact with a contact part of a rotary contact body and a fixed contact body and via the second contact via a second connection conductor which is arranged between the second contact arm and the second busbar assigned to the second contact arm, and the current flow in the double contact passes out via the second busbar.

8. The contact mechanism recited in claim 1, wherein the first current conductor and the second current conductor are insulated from each other.

9. The contact mechanism recited in claim 8, wherein the first current conductor and the second current conductor lie on one another with an insulating layer there between.

10. The contact mechanism recited in claim 1, wherein the contact mechanism is constructed as a single-pole double-contact, the rotary contact body being formed as a two-armed rotary contact body having two opposing contact arms, while a moving contact part and a fixed contact part are formed at lever arm ends of the two opposing contact arms, and wherein the current path in the double contact in the order of the current flow is as follows:

from a first busbar lying on a first side of the double contact to a second busbar lying on a second side of the double contact via the second contact comprising the fixed contact and the moving contact of the double contact, on the second side of the double contact via an entire length of the contact arm and via the first contact comprising the fixed contact and the moving contact of the double contact, to a second busbar lying on the first side of the double contact and from there to a second busbar lying on the second side of the double contact.

* * * * *